US009459586B2

(12) United States Patent
Matsumoto

(10) Patent No.: US 9,459,586 B2
(45) Date of Patent: Oct. 4, 2016

(54) IMAGE FORMING APPARATUS AND DETACHABLE UNIT FOR USE THEREWITH

(71) Applicant: Oki Data Corporation, Tokyo (JP)

(72) Inventor: Keigo Matsumoto, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/803,929

(22) Filed: Jul. 20, 2015

(65) Prior Publication Data

US 2016/0062313 A1 Mar. 3, 2016

(30) Foreign Application Priority Data

Aug. 28, 2014 (JP) ..... 2014-173860

(51) Int. Cl.
*G03G 15/00* (2006.01)
*G03G 21/18* (2006.01)
*G03G 15/08* (2006.01)

(52) U.S. Cl.
CPC ..... *G03G 21/1867* (2013.01); *G03G 15/0863* (2013.01); *G03G 21/1885* (2013.01)

(58) Field of Classification Search
CPC ..... G03G 21/1885
See application file for complete search history.

(56) References Cited

U.S. PATENT DOCUMENTS

2003/0123896 A1* 7/2003 Goto ..... G03G 21/1871 399/90
2003/0215257 A1* 11/2003 Karakama ..... G03G 21/1853 399/90
2003/0215261 A1* 11/2003 Karakama ..... G03G 21/1871 399/111
2006/0228127 A1* 10/2006 Miyabe ..... G03G 21/1867 399/90
2012/0256991 A1* 10/2012 Kodama ..... B41J 2/1752 347/86
2012/0258637 A1* 10/2012 Kodama ..... H01R 12/7082 439/676
2013/0083499 A1* 4/2013 Kamiya ..... B41J 13/103 361/752
2014/0168324 A1* 6/2014 Sasaki ..... B41J 2/1752 347/86
2015/0153706 A1* 6/2015 Tani ..... G03G 21/18 399/109
2016/0067977 A1* 3/2016 Qin ..... B41J 2/1753 347/86

FOREIGN PATENT DOCUMENTS

| | | | |
|---|---|---|---|
| EP | 1363168 | A2 | 11/2003 |
| EP | 2762982 | A1 | 8/2014 |
| JP | 2007-140266 | A | 6/2007 |
| JP | 2011-118160 | A | 6/2011 |

* cited by examiner

*Primary Examiner* — David Gray
*Assistant Examiner* — Geoffrey T Evans
(74) *Attorney, Agent, or Firm* — Rabin & Berdo, P.C.

(57) ABSTRACT

An image forming apparatus includes an apparatus main body and a contact terminal, and a detachable unit including a holder for holding a circuit board having an electrode terminal which comes into contact with the contact terminal. A state of the detachable unit is changed to an attached state by inserting it in an insertion direction, and is changed to a detached state by withdrawing the detachable unit in a withdrawal direction. The holder includes a first positioning member for positioning a tip end of the circuit board in the insertion direction when the detachable unit holding the circuit board in the holder is slid in the insertion direction. The first positioning member includes a notch configured so that the contact terminal passes through the notch when the detachable unit not holding the circuit board in the holder in the attached state is slid in the withdrawal direction.

19 Claims, 16 Drawing Sheets

FIG. 9A
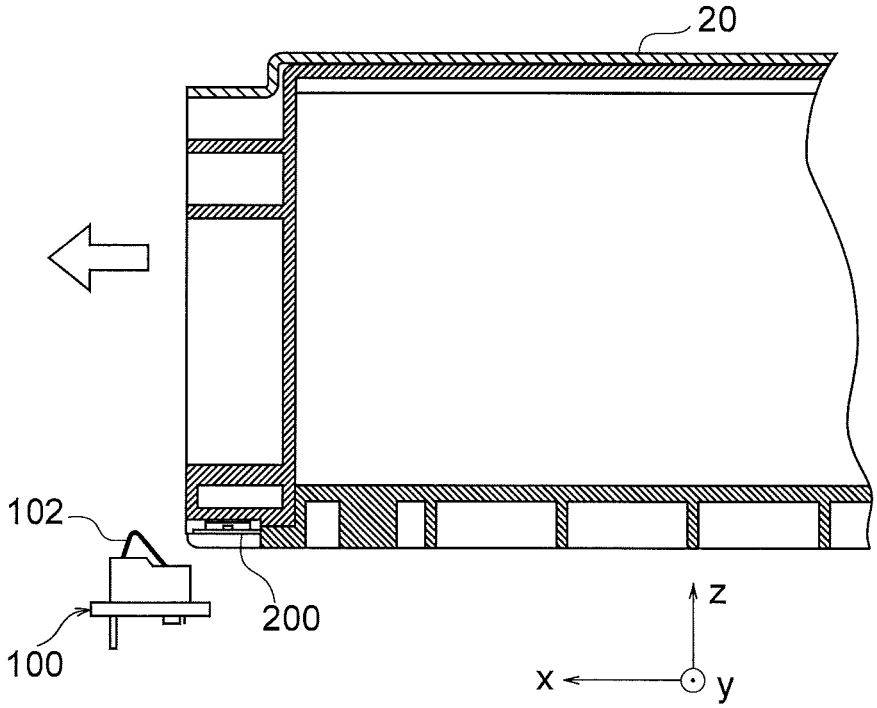
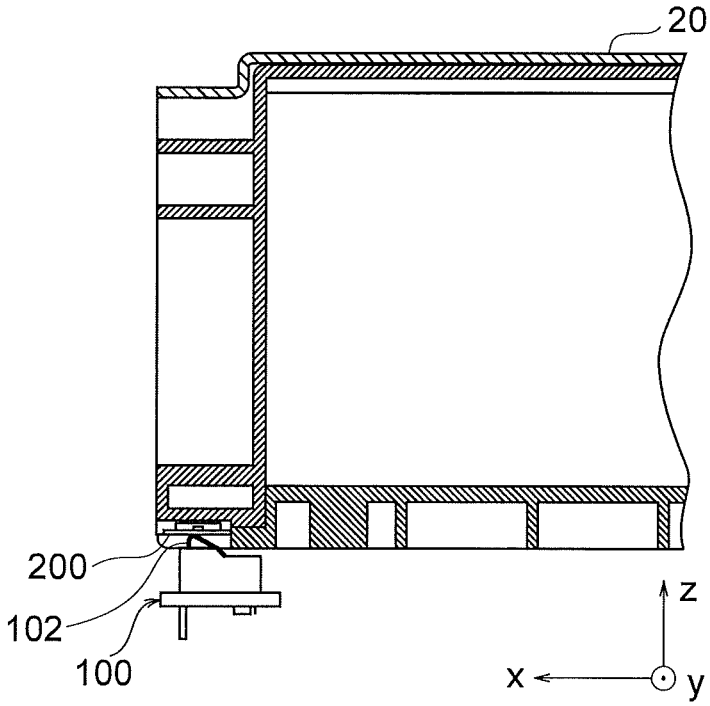
FIG. 9B

IMAGE FORMING APPARATUS AND DETACHABLE UNIT FOR USE THEREWITH

BACKGROUND OF THE INVENTION

1. Field of the Invention

The present invention relates to image forming apparatuses each of which includes a detachable unit and detachable units that can be attached to and detached from image forming apparatuses.

2. Description of the Related Art

Conventionally, image forming apparatuses have a detachable unit that can be slid along a guide section of an apparatus main body when it is inserted into or withdrawn from the apparatus main body. One example of the detachable unit is a toner cartridge. In general, the detachable unit includes a holder for holding a circuit board (cartridge circuit board), and a terminal board having a contact terminal as a leaf spring is mounted on the apparatus main body. When the detachable unit is inserted into the guide section of the apparatus main body, an electrode terminal of the circuit board held in the holder of the detachable unit comes into contact with the contact terminal.

When the user inserts the detachable unit holding the circuit board in the holder along the guide section into the apparatus main body, the contact terminal in its initial state (non-pressed state) meets a part on the front end side of the holder of the detachable unit and is pushed down. When the insertion is completed, the contact terminal held in the holder is in the pressed state and is kept in contact with the electrode terminal of the circuit board by its elastic restoring force.

When the user draws out the detachable unit holding the circuit board in the holder from the apparatus main body by sliding it along the guide section, the detachable unit held in the holder moves while keeping the electrode terminal of the circuit board in contact with the contact terminal. When the detachable unit moves away from the contact terminal, the contact terminal returns from the pressed state to the initial state by its elastic restoring force. See Patent reference 1, Japanese patent application publication No. 2007-140266.

There is a possibility that a detachable unit which does not hold a circuit board in the holder (for example, a detachable unit before a circuit board is mounted or a detachable unit after a circuit board has been removed) is inserted into the apparatus main body along the guide section. When the user inserts the detachable unit not holding a circuit board in the holder into the apparatus main body along the guide section, the contact terminal in its initial state meets a part of the detachable unit (for example, a frame of the detachable unit) and is temporarily pushed down. However, when the insertion is completed, the contact terminal returns to its initial state by its elastic restoring force, and at least a part of the contact terminal enters into the holder (space where the circuit board would be present) of the detachable unit. If the user withdraws the detachable unit in that state by sliding it along the guide section, at least the part of the contact terminal which has been entering in the holder of the detachable unit would be caught by a part of the detachable unit (for example, a frame of the detachable unit), and the detachable unit would disturb smooth pulling-out of the detachable unit.

SUMMARY OF THE INVENTION

An object of the present invention is to provide an image forming apparatus and a detachable unit that will allow the user to pull out the detachable unit smoothly when the user pulls out the detachable unit from the apparatus main body.

An image forming apparatus according to an aspect of the present invention includes: an apparatus main body including a guide section and a contact terminal as a spring; and a detachable unit including a holder for holding a circuit board having an electrode terminal which comes into contact with the contact terminal. A state of the detachable unit is changed to an attached state by inserting the detachable unit along the guide section in an insertion direction, and the state of the detachable unit is changed to a detached state by withdrawing the detachable unit along the guide section in a withdrawal direction opposite to the insertion direction. The holder includes a first positioning member for positioning a tip end of the circuit board in the insertion direction when the detachable unit holding the circuit board in the holder is slid along the guide section to be inserted in the insertion direction. The first positioning member includes a notch configured so that the contact terminal passes through the notch when the detachable unit not holding the circuit board in the holder in the attached state is slid in the withdrawal direction.

A detachable unit according to another aspect of the present invention, is configured to be inserted into and to be withdrawn from an image forming apparatus that includes a guide section and a contact terminal as a spring. A state of the detachable unit is changed to an attached state by inserting the detachable unit along the guide section in an insertion direction, and the state of the detachable unit is changed to a detached state by withdrawing the detachable unit along the guide section in a withdrawal direction opposite to the insertion direction. The detachable unit includes: a unit main body; and a holder provided on the unit main body, the holder being configured to hold a circuit board including an electrode terminal which comes into contact with the contact terminal. The holder includes a first positioning member for positioning a tip end of the circuit board in the insertion direction when the detachable unit holding the circuit board in the holder is slid along the guide section to be inserted in the insertion direction. The first positioning member includes a notch configured so that the contact terminal passes through the notch when the detachable unit not holding the circuit board in the holder in the attached state is slid in the withdrawal direction.

According to the present invention, the detachable unit is pulled out smoothly from the apparatus main body when the user pulls out the detachable unit from the apparatus main body.

BRIEF DESCRIPTION OF THE DRAWINGS

In the drawings:

FIG. 9A is a longitudinal sectional view showing the toner cartridge and the contact terminal provided on the side of the apparatus main body in the first embodiment (when the toner cartridge is being inserted);

FIG. 9B is another longitudinal sectional view showing the toner cartridge and the contact terminal provided on the side of the apparatus main body in the first embodiment (when the insertion of the toner cartridge is completed);

DETAILED DESCRIPTION OF THE INVENTION

Figure 1:
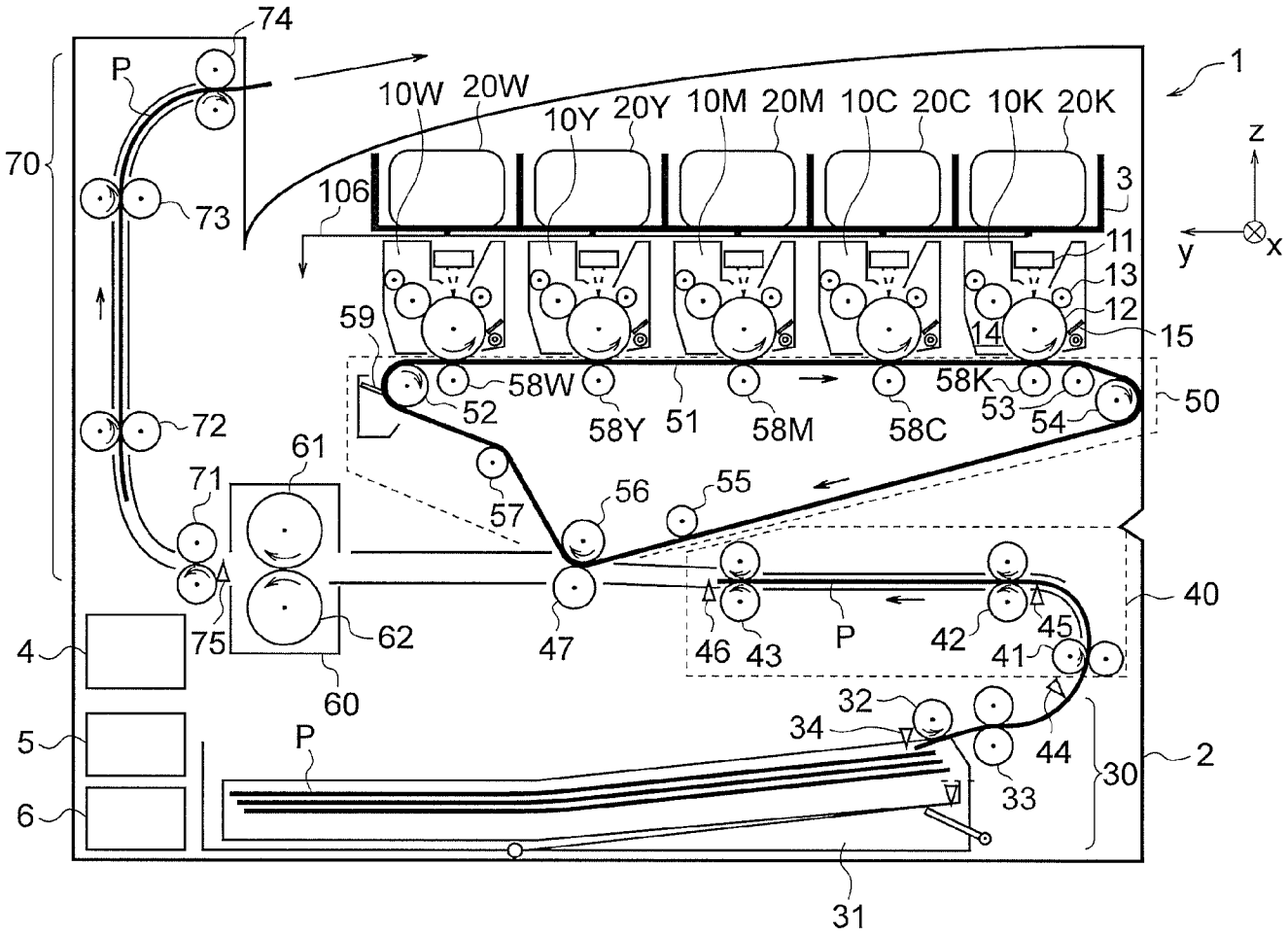
FIG. 1 is a longitudinal sectional view schematically showing the structure of an image forming apparatus in a first embodiment of the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications will become apparent to those skilled in the art from the detailed description.

Embodiments of the present invention will be described with reference to drawings. In the xyz orthogonal coordinate system shown in the drawings, the x-axis represents a direction of insertion (insertion direction) of the detachable unit (a long-side direction of a toner cartridge as the detachable unit in the embodiments). In the xyz orthogonal coordinate system, the y-axis represents a direction of width of the detachable unit (a short-side direction of the toner cartridge in the embodiments). In the xyz orthogonal coordinate system, the z-axis represents a direction of height of the detachable unit, orthogonal to both the x-axis and the y-axis (a direction of height of the image forming apparatus in the embodiments).

First Embodiment

FIG. 1 is a longitudinal sectional view schematically showing the structure of an image forming apparatus 1 in a first embodiment of the present invention. The image forming apparatus 1 is an electrophotographic color printer, for example. As shown in FIG. 1, an apparatus main body of the image forming apparatus 1 includes at least a housing 2 and a guide section 3 disposed in the housing 2. The image forming apparatus 1 further includes a power supply unit (a voltage supply unit) 4 which supplies electric power (a voltage) to the components of the image forming apparatus 1, a driving unit 5 (including a driving force generating unit such as a motor, and a driving force transfer unit such as a gear) which gives driving force to the components of the image forming apparatus 1, and a control section 6 which controls the operation of the image forming apparatus 1.

The image forming apparatus 1 includes image forming sections (image forming units) 10W, 10Y, 10M, 100, and 10K for forming developer (toner) images of various colors in an electrophotographic process, toner cartridges (developer cartridges) 20W, 20Y, 20M, 20C, and 20K for supplying toner of corresponding colors to the image forming sections 10W, 10Y, 10M, 100, and 10K, and a medium supply portion (paper feed unit) 30 for supplying recording medium P such as paper. The image forming apparatus 1 also includes a medium conveying portion (medium conveying section) 40 which conveys the recording medium P, an intermediate transfer unit (transfer belt unit) 50 including an intermediate transfer belt 51 for transferring color toner images formed by the image forming sections 10W, 10Y, 10M, 100, and 10K, a fixing unit 60 for fixing toner images transferred from the intermediate transfer belt 51 onto the recording medium P, and a medium discharge portion (paper discharge section) 70 for discharging the recording medium P, which has passed through the fixing unit 60, onto a stacker (stacking portion) disposed outside the housing 2.

FIG. 1 shows five image forming sections 10W, 10Y, 10M, 100, and 10K and five toner cartridges 20W, 20Y, 20M, 20C, and 20K, but the number of image forming sections and the number of toner cartridges included in the image forming apparatus 1 may be four or less and may be six or more. FIG. 1 shows a color printer, but the present invention can be applied to a monochrome printer having a single image forming section. The present invention can be applied also to other types of electrical equipment including an apparatus main body and a detachable unit such as a toner cartridge which can be inserted into and withdrawn from the apparatus main body. For example, the present invention can be applied to other types of electric equipment such as a copier, a facsimile apparatus, and a multifunction peripheral (MFP).

As shown in FIG. 1, the medium supply portion 30 includes a medium cassette (paper cassette) 31 mounted in the housing 2, a paper feed roller (hopping roller) 32 for sending out the recording medium P one by one stacked in the medium cassette 31, and a roller pair 33 for conveying the recording medium P sent out from the medium cassette 31, toward the medium conveying portion 40. The medium supply portion 30 may have a medium sensor 34 for detecting the presence or absence of the recording medium P in the medium cassette 31. The structure of the medium supply portion 30 is not limited to the example shown in FIG. 1 and may have another structure.

The image forming sections 10W, 10Y, 10M, 100, and 10K form a white (W) toner image, a yellow (Y) toner image, a magenta (M) toner image, a cyan (c) toner image, and a black (K) toner image respectively by an electrophotographic process. The toner cartridges 20W, 20Y, 20M, 20C, and 20K as detachable units contain white toner, yellow toner, magenta toner, cyan toner, and black toner respectively, and supply them to the corresponding developing devices 14 of the image forming sections 10W, 10Y, 10M, 100, and 10K respectively. The user can insert (slide) each of the toner cartridges 20W, 20Y, 20M, 20C, and 20K in the insertion direction (+x direction) along the guide section 3 disposed in the apparatus main body. By inserting them in the insertion direction, a state of each of the toner cartridges 20W, 20Y, 20M, 20C, and 20K is changed from a detached state to an attached state. Further, the user can pull out (slide) each of the toner cartridges 20W, 20Y, 20M, 20C, and 20K in a withdrawal direction (−x direction) opposite to the insertion direction along the guide section 3. By withdrawing them in the withdrawal direction, a state of each of the toner cartridges 20W, 20Y, 20M, 20C, and 20K is changed from the attached state to the detached state. The toner cartridges 20W, 20Y, 20M, 20C, and 20K are examples of detachable units to which the present invention is applied. Toner used with the image forming section 10W and the toner cartridge 20W may be transparent toner instead of white toner.

The image forming sections 10W, 10Y, 10M, 100, and 10K have basically identical structures with each other except that the colors of toner are different from each other. The toner cartridges 20W, 20Y, 20M, 20C, and 20K have basically identical structures with each other except that the colors of toner are different from each other. Each of the image forming sections 10W, 10Y, 10M, 100, and 10K includes a light exposure unit (optical writing head) 11 which functions as an exposure device, a photosensitive drum 12 which is rotatably supported and functions as an image carrier, and a charging roller 13 for charging a surface of the photosensitive drum 12 uniformly. Each of the image forming sections 10W, 10Y, 10M, 100, and 10K also includes a developing device 14 for supplying toner onto the surface of the photosensitive drum 12, thereby forming the toner image corresponding to an electrostatic latent image which has been formed on the surface of the photosensitive drum 12 by exposure with the light exposure unit 11, and a cleaning blade 15 for cleaning the surface of the photosensitive drum 12. The light exposure unit 11 is an LED head including an LED array configured so that a plurality of LEDs (light emitting diodes) arranged in the direction of axis of the photosensitive drum 12, for example. The light exposure unit 11 receives a driving signal based on the image data of each color and irradiates the surface of the photosensitive drum 12 with exposure light corresponding to the driving signal. The developing device 14 includes a toner storage member which forms a developer storage space for containing toner, a developing roller which supplies toner to the surface of the photosensitive drum 12, and a supply roller which supplies toner stored in the toner storage member to the developing roller. The structure of the image forming sections 10W, 10Y, 10M, 100, and 10K is not limited to the example described above and may have a different structure.

As shown in FIG. 1, the medium conveying portion 40 includes roller pairs 41, 42, and 43 which convey the recording medium P supplied from the medium supply portion 30 and medium sensors 44, 45, and 46 which detect the recording medium P. The structure of the medium conveying portion 40 is not limited to the example shown in FIG. 1 and may have a different structure.

As shown in FIG. 1, the intermediate transfer unit 50 includes rollers 52, 53, 54, 55, 56, and 57 for movably supporting the intermediate transfer belt 51, first transfer rollers 58W, 58Y, 58M, 58C, and 58K which transfer respective toner images on the photosensitive drums 12 of the image forming sections 10W, 10Y, 10M, 100, and 10K onto the intermediate transfer belt 51, and a cleaning blade 59 which removes the toner remaining on a surface of the intermediate transfer belt 51. The toner images transferred onto the intermediate transfer belt 51 are transferred onto the recording medium P by a second transfer roller 47. The structure of the intermediate transfer unit 50 is not limited to the example shown in FIG. 1 and may have a different structure. The present invention can also be applied to an image forming apparatus which does not have the intermediate transfer unit 50 and transfers the toner images directly from the image forming sections 10W, 10Y, 10M, 100, and 10K onto the recording medium P.

As shown in FIG. 1, the fixing unit 60 includes a pair of rollers 61 and 62 which press each other. The roller 61 is a heat roller containing a heater in its inside, and the roller 62 is a pressure roller which is pressed against the roller 61. When an unfixed toner image on the recording medium P passes between the rollers 61 and 62 of the fixing unit 60, the toner image is fixed onto the recording medium P by heat and pressure. The structure of the fixing unit 60 is not limited to the example shown in FIG. 1 and may have a different structure.

As shown in FIG. 1, the medium discharge portion 70 includes roller pairs 71, 72, 73, and 74, each of which includes a pair of rollers facing and pressing each other. Each of the roller pairs 71, 72, 73, and 74 includes a roller which is rotated by the driving force to convey the recording medium P. The roller pairs 71, 72, 73, and 74 discharge the recording medium P which has passed through the fixing unit 60 onto the stacker disposed outside the housing 2. The medium discharge portion 70 may include a medium sensor 75 which detects the recording medium P. The structure of the medium discharge portion 70 is not limited to the example shown in FIG. 1 and may further include another roller pair, another sensor for detecting the passing of the recording medium P, and so on.

The image forming apparatus 1 shown in FIG. 1 may further include a paper turning mechanism which turns around the recording medium P which has passed through the fixing unit 60 and sends the turned recording medium P to the medium conveying portion 40, in order to print images on both faces of the recording medium P.

Figure 2A:
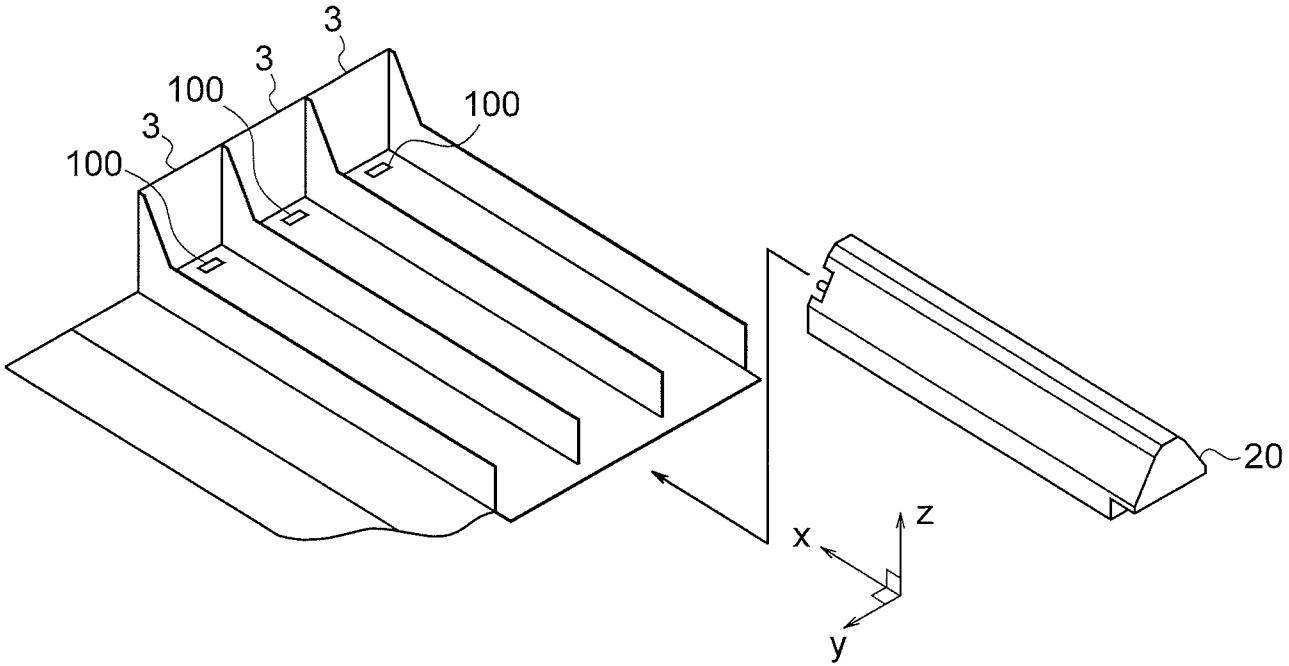
FIG. 2A is a perspective view schematically showing how a toner cartridge as a detachable unit in the first embodiment is inserted into a guide section disposed in an apparatus main body of the image forming apparatus.
Figure 2B:
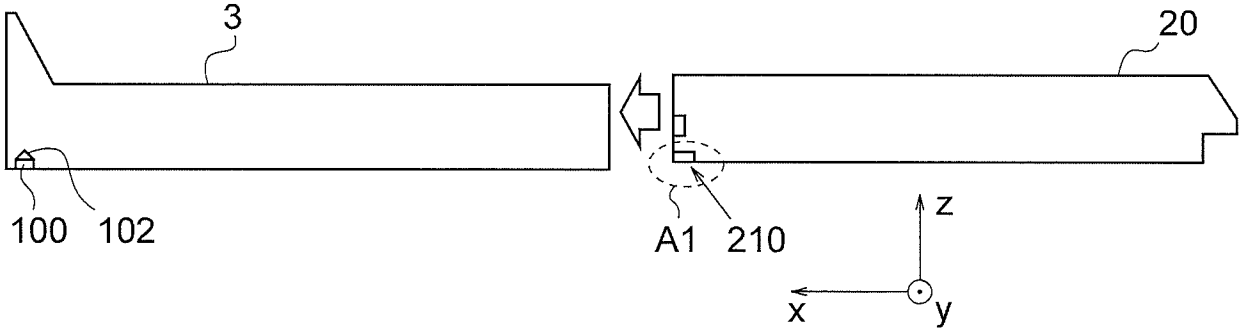
FIG. 2B is a longitudinal sectional view schematically showing how the toner cartridge as the detachable unit in the first embodiment is inserted into the guide section disposed in the apparatus main body.

FIGS. 2A and 2B are respectively a perspective view and a sectional view schematically showing how the toner cartridge 20 (any of 20W, 20Y, 20M, 20C, and 20K) as a detachable unit in the first embodiment is slid along the guide section 3 and is inserted into the apparatus main body. As shown in FIGS. 2A and 2B, the image forming apparatus 1 includes five guide sections 3 arranged parallel to the y direction in the housing 2, and the toner cartridges 20 (any of 20W, 20Y, 20M, 20C, and 20K) are attached to each of the guide sections 3. As shown in FIGS. 2A and 2B, each of the guide sections 3 includes a terminal board 100 as a base plate having a contact terminal 102. As shown in FIG. 2B, a holder 210 for holding a circuit board is provided on a frame as a unit main body of the toner cartridge 20.

Figure 3:
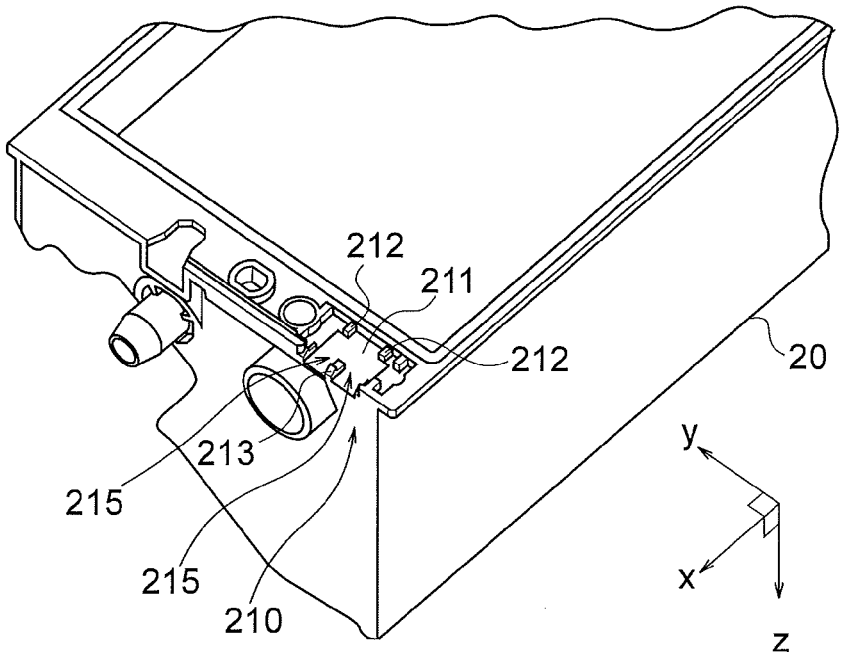
FIG. 3 is a perspective view showing a holder of the toner cartridge in the first embodiment.
Figure 4:
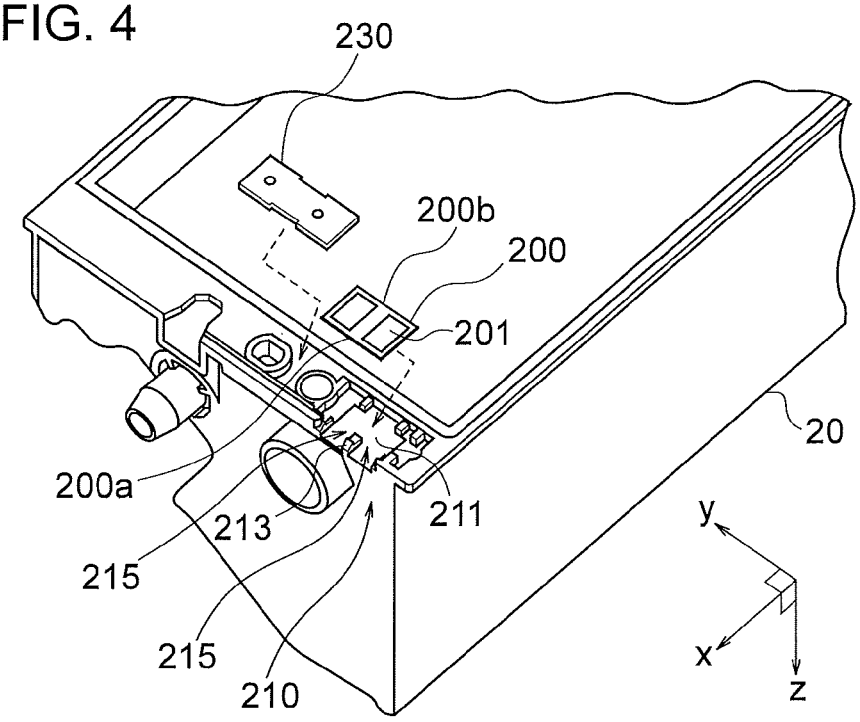
FIG. 4 is a perspective view showing the holder of the toner cartridge, a circuit board, and a securing member in the first embodiment.
Figure 5:
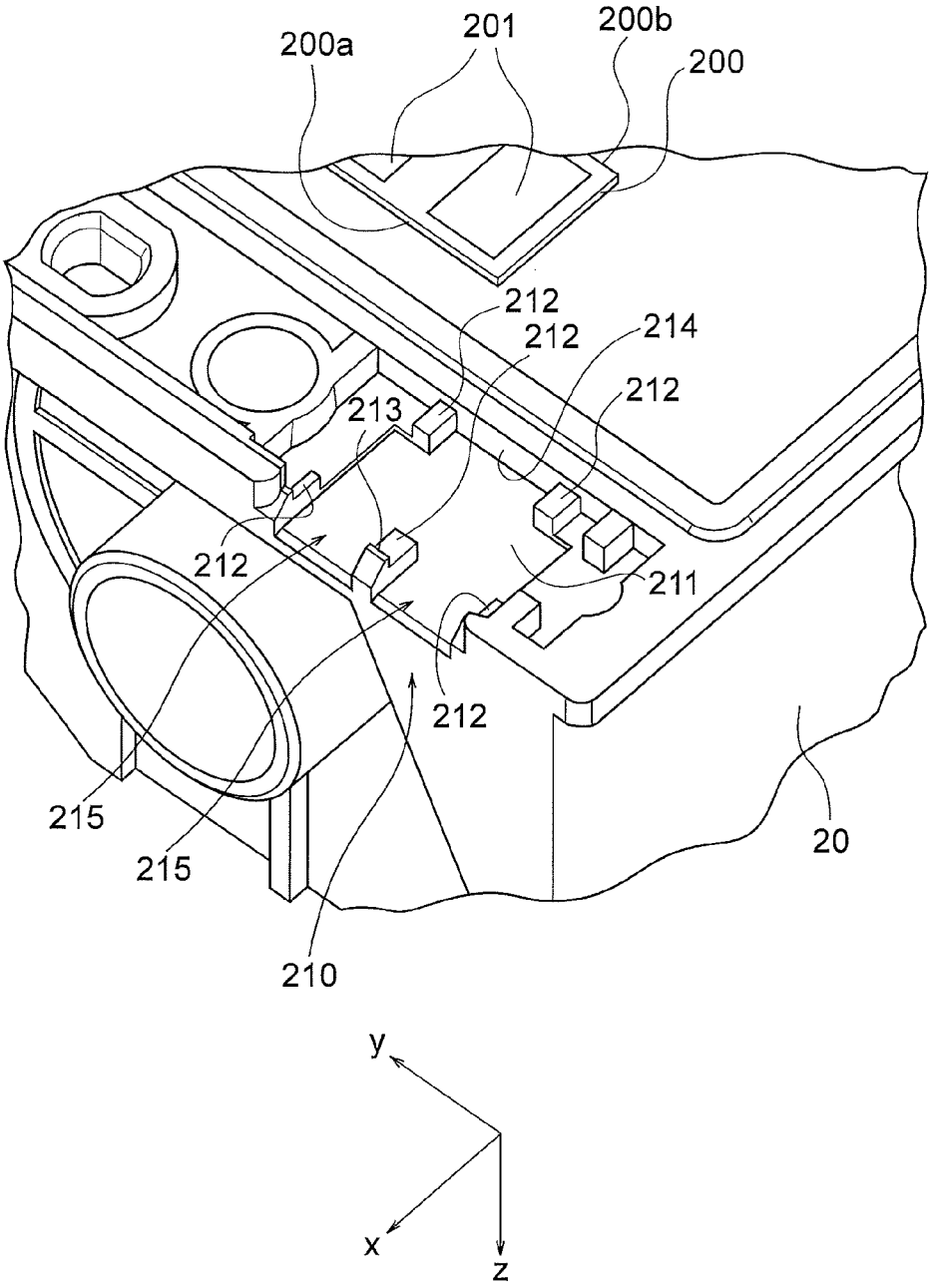
FIG. 5 is an enlarged perspective view showing the holder of the toner cartridge in the first embodiment.
Figure 6:
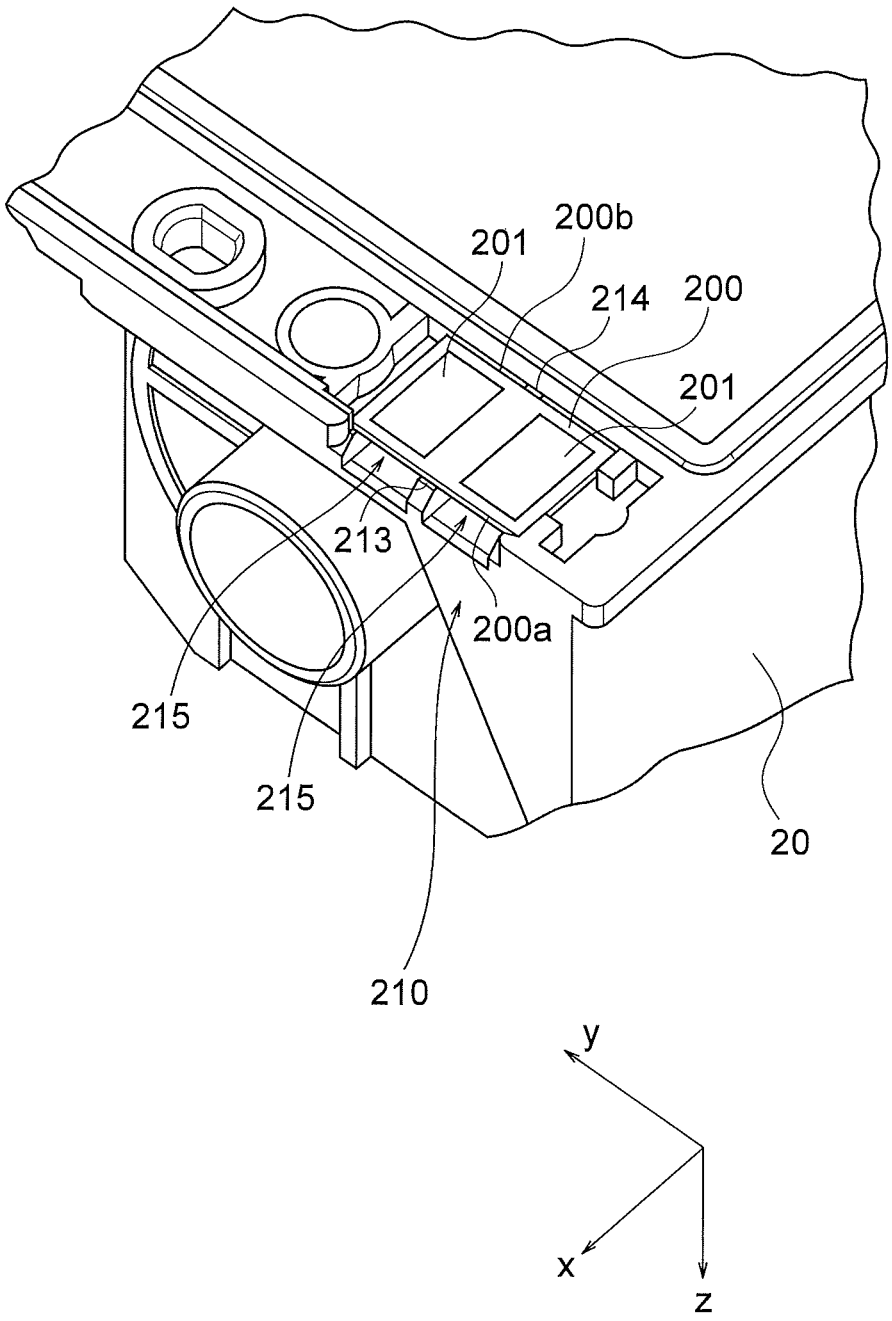
FIG. 6 is an enlarged perspective view showing the holder of the toner cartridge and the circuit board placed in the holder in the first embodiment.

FIG. 3 is a perspective view showing the holder 210 of the toner cartridge 20 provided in an area A1 in FIG. 2B, and FIG. 4 is a perspective view showing the holder 210 of the toner cartridge 20 provided in the area A1 in FIG. 2B, the circuit board 200 placed in the holder 210, and a securing member 230 (in a state before the circuit board 200 and the securing member 230 are attached) for securing the circuit board 200 in the holder to the frame. FIG. 5 is an enlarged perspective view showing the holder 210 of the toner cartridge 20 provided in the area A1 in FIG. 2B, and FIG. 6 is an enlarged perspective view showing the holder 210 of the toner cartridge 20 provided in the area A1 of FIG. 2B and the circuit board 200 disposed on the holder 210. The holder 210 of the circuit board 200 in the toner cartridge 20 includes a recess (i.e., depressed part) 211 of which planar shape is nearly rectangular, a plurality of ribs (base parts or base members) 212 disposed in the recess 211, a first positioning member (first positioning part) 213, and a second positioning member (second positioning part) 214. The top faces of the plurality of ribs 212 are on the same level in height. One face (which is opposed to a face on which the electrode terminal 201 is provided) of the circuit board 200 is supported by the top faces of the plurality of ribs 212. The first positioning member 213 comes into contact with a side 200*a* (front side) as a tip end of the circuit board 200 and positions the circuit board 200 in the insertion direction (+x direction). The second positioning member 214 comes into contact with a side 200*b*, which is different from the side 200*a*, of the circuit board 200 and positions the circuit board 200 in the withdrawal direction (−x direction).

Figure 7A:
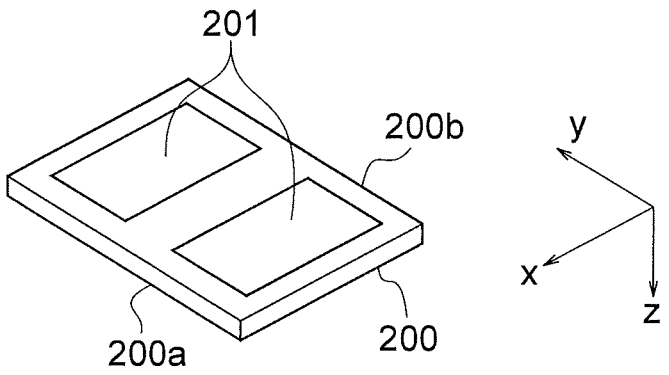
FIG. 7A is a perspective view showing electrode terminals of the circuit board of the toner cartridge in the first embodiment.
Figure 7B:
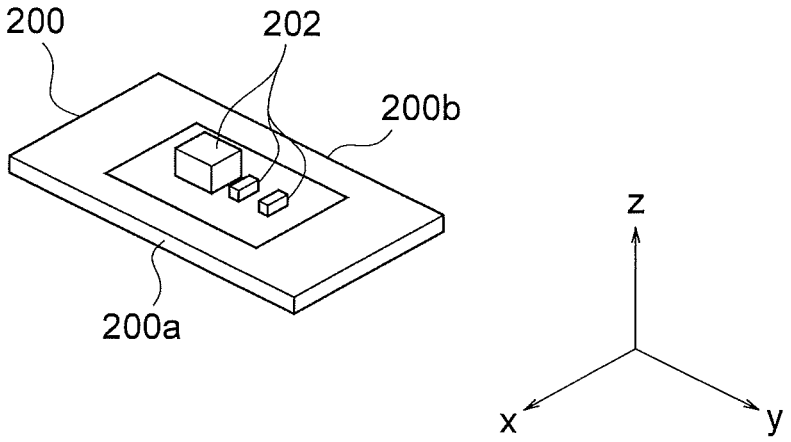
FIG. 7B is a perspective view showing a semiconductor element of the circuit board of the toner cartridge in the first embodiment.

FIG. 7A is a perspective view showing a side of the electrode terminal 201 of the circuit board 200 held in the holder 210 of the toner cartridge 20 in the image forming apparatus 1. FIG. 7B is a perspective view showing a side of the semiconductor element 202 of the circuit board 200 of the toner cartridge 20 in the image forming apparatus 1. It is preferable that the electrode terminal 201 of the circuit board 200 be a tabular electrode parallel to the insertion direction (+x direction). A substrate part of the circuit board 200 has a size of about 15 mm in length, about 10 mm in width, and about 1 mm in thickness, for example. The semiconductor element 202 includes a memory element and stores information about the toner cartridge such as identification information for identifying the toner cartridge. The information which is stored by the memory element can include a variety of information such as information indicating the amount of the toner consumed, information indicating whether the toner cartridge is a new one or not, and information indicating the color of the toner.

The apparatus main body of the image forming apparatus 1 includes the guide section 3 and the terminal board 100 having two contact terminals 102 as springs having a spring characteristic. The toner cartridge 20 includes the holder 210 for holding the circuit board 200 which has two electrode terminals 201 to come into contact with the contact terminals 102. To change the state of the toner cartridge 20 from the detached state to the attached state, the user inserts the toner cartridge 20 into the apparatus main body by sliding it along the guide section 3 in the insertion direction (+x direction). To change the state of the toner cartridge 20 from the attached state to the detached state, the user withdraws the toner cartridge 20 from the apparatus main body by sliding it along the guide section 3 in the withdrawal direction (−x direction). The holder 210 includes the first positioning member 213 which positions the front side 200*a* as the tip end of the circuit board 200 held in the holder in the insertion direction (+x direction) when the toner cartridge 20 holding the circuit board 200 in the holder 210 is slid along the guide section 3 to be inserted in the insertion direction. The first positioning member 213 includes notches as cut parts (slit parts) 215 configured so that two contact terminals 102 pass through the notches 215 when the toner cartridge 20 not holding the circuit board 200 in the holder 210 (in the attached state) is slid in the withdrawal direction (−x direction). The number of the contact terminals 102 may be one and may be three or more. The number of the notches 215 may be one and may be three or more. The notch 215 should preferably have such a shape that the holder 210 does not touch the contact terminal 102 while the toner cartridge 20 is being inserted into the apparatus main body and is being withdrawn from the apparatus main body. If the bottom face of the notch 215 in the holder 210 is smooth (free of acute parts) and if the bottom face is lower than the ribs 212, even when the bottom face of the notch 215 of the holder 210 touches the contact terminal 102 while the toner cartridge 20 is being inserted into and being withdrawn from the apparatus main body, damage to the contact terminals 102 can be prevented.

The holder 210 includes the second positioning member 214 which positions the side 200*b* as a rear end of the circuit board 200 held in the holder 210 in the insertion direction (+x direction) and the recess 211 formed between the first positioning member 213 and the second positioning member 214. The first positioning member 213 and the second positioning member 214 are formed on a level higher than the top faces of the ribs 212. The recess 211 is formed on a level lower than the top faces of the ribs 212.

Figure 8:
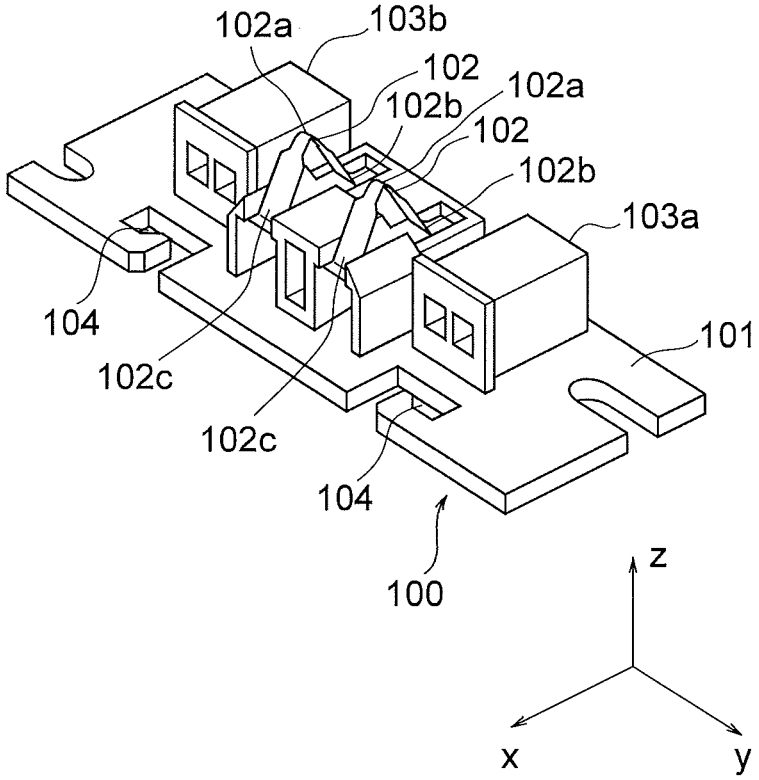
FIG. 8 is an enlarged perspective view showing a terminal board mounted on the apparatus main body of the image forming apparatus in the first embodiment.

FIG. 8 is an enlarged perspective view showing the terminal board 100 mounted on the apparatus main body of the image forming apparatus 1 in the first embodiment. The terminal board 100 includes board part 101 (printed board) having a first face on which the contact terminal 102 as a spring is disposed and a second face opposite to the first face. In other words, the terminal board 100 supports the two contact terminals 102 as springs on the first face (board part 101). The terminal board 100 also includes two connectors 103*a* and 103*b* for electrically connecting the two contact terminals 102 to signal cables respectively. Each of the contact terminals 102 is an L-shaped leaf spring member which functions as a spring. The contact terminals 102 and the connectors 103*a* and 103*b* are electrically connected through printed wiring printed on a surface of the terminal board 100. Accordingly, the contact terminals 102 and the signal cables 106 are electrically connected via the connectors 103*a* and 103*b*. An apex part 102*a* of the contact terminal 102 bent into the L-shape is a contact part which comes into contact with the electrode terminal 201 of the circuit board 200 held in the holder 210. The apex part 102*a* is formed by bending a plate member into L-shape, for example. In the attached state where the toner cartridge 20 holding the circuit board 200 in the holder 210 is inserted into the apparatus main body, the contact terminals 102 are in contact with the electrode terminals 201. It is preferable that the apex part 102*a* of the contact terminal 102 be plated with gold. When a load is applied to the apex part 102*a* of the contact terminal 102 from above, the apex part 102*a* of the contact terminal 102 is compressed and pushed down toward the board part 101. When the load on the apex part 102*a* of the contact terminal 102 is released, the apex part 102*a* of the contact terminal 102 returns to its initial state by the elastic restoring force of the contact terminal 102. An end part 102*b* of the contact terminal 102 on a rear end side opposite to a tip end side in the insertion direction (+x direction) is a fixed end which is fixed to the apparatus main body (more specifically, the board part 101, for example). Another end part 102*c* of the contact terminal 102 on the tip end side opposite to the rear side in the insertion direction (+x direction) is a free end which is not fixed to the board part 101. In other words, the fixed end is formed on the rear end side of the contact terminal 102 in the insertion direction, and the free end is formed on the tip end side of the contact terminal 102 in the insertion direction. Accordingly, if a load is applied to the apex part 102*a* (contact part) of the contact terminal 102 from above, the fixed end (the end part 102*b*) of the contact terminal 102 functions as a fulcrum, and a free end side (the end part 102*c*) is pushed down toward the board part 101. The structure of the terminal board 100 is not limited to the example shown in FIG. 8, and a variety of modifications are possible. The terminal board 100 includes L-shaped notches 104 as a part of a cable guide, which will be described in the description of a second embodiment.

FIG. 9A is a longitudinal sectional view showing the toner cartridge 20 and the contact terminal 102 provided on the side of the apparatus main body in the first embodiment (when the toner cartridge 20 is being inserted), and FIG. 9B is a longitudinal sectional view showing the toner cartridge 20 and the contact terminal 102 provided on the side of the apparatus main body in the first embodiment (when the insertion of the toner cartridge 20 is completed). When the toner cartridge 20 holding the circuit board 200 in the holder 210 is inserted into the apparatus main body along the guide section 3, the contact terminal 102 changes its state from the initial state (FIG. 9A) in which no load is applied to the contact terminal 102, to a contact state (FIG. 9B) in which it meets the circuit board 200 held in the holder 210 and is pushed down by the circuit board 200. The contact terminal 102 is in contact with the electrode terminal 201 when the toner cartridge 20 holding the circuit board 200 in the holder 210 is in the attached state (contact state). When the toner cartridge 20 holding the circuit board in the holder 210 is withdrawn from the apparatus main body along the guide section 3, the contact terminal 102 returns from the contact state (FIG. 9B) to the initial state (FIG. 9A).

Figure 10:
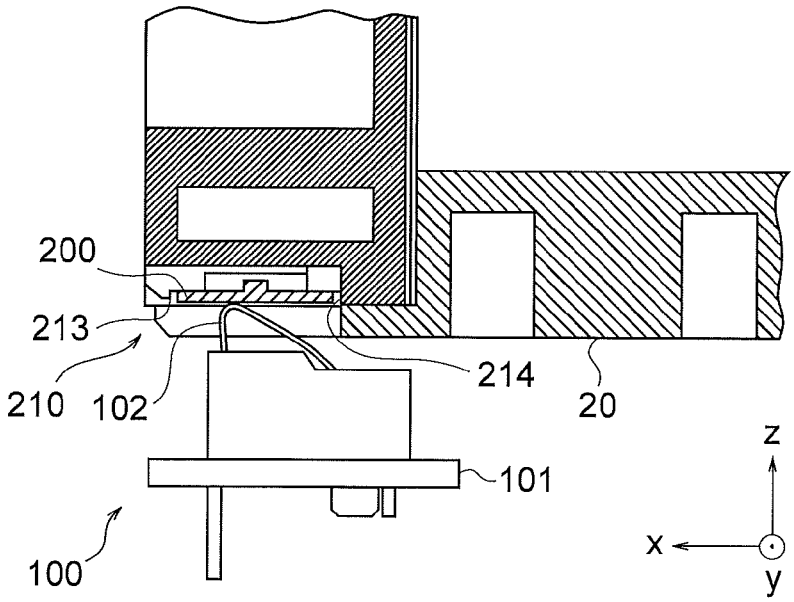
FIG. 10 is an enlarged sectional view showing the toner cartridge holding the circuit board in the holder and the contact terminal provided on the side of the apparatus main body (when the insertion of the toner cartridge is completed) in the first embodiment.

FIG. 10 is an enlarged sectional view showing the toner cartridge 20 (holding the circuit board 200) and the contact terminal 102 provided on the side of the apparatus main body (when the insertion of the toner cartridge 20 is completed) in the first embodiment. As shown in FIG. 10, when the toner cartridge 20 holding the circuit board 200 in the holder 210 is inserted into the apparatus main body along the guide section 3, the shape of the contact terminal 102 changes from the initial state (FIG. 9A), in which no load is applied, to the contact state, in which it comes into contact with or meets the circuit board 200 held in the holder 210 and is pushed down thereby.

Figure 11:
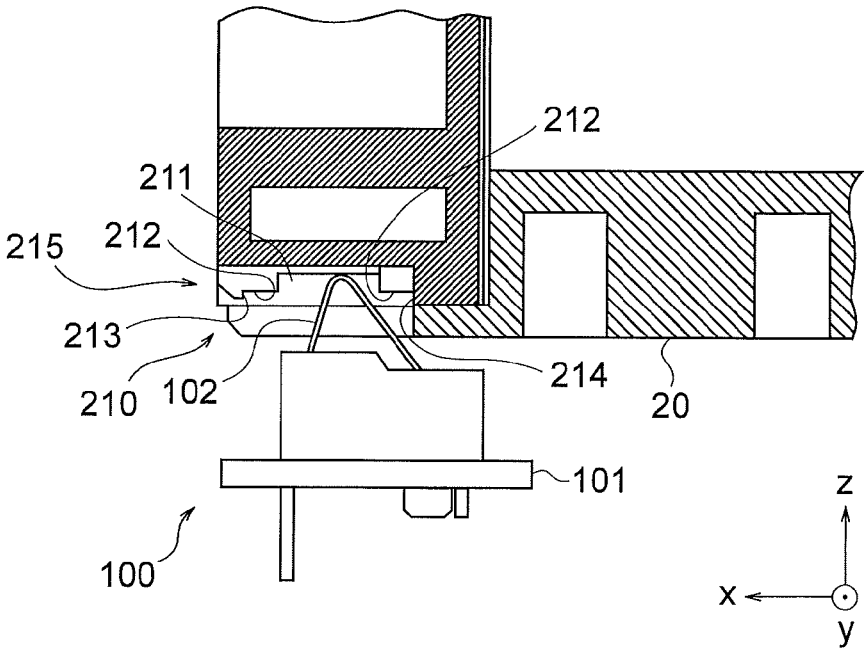
FIG. 11 is an enlarged sectional view showing the toner cartridge holding no circuit board in the holder and the contact terminal provided on the side of the apparatus main body (when the insertion of the toner cartridge is completed) in the first embodiment.

FIG. 11 is an enlarged sectional view showing the toner cartridge 20 (not holding the circuit board 200 in the holder 210, i.e., holding no circuit board in the holder 210) and the contact terminal 102 provided on the side of the apparatus main body (when the insertion of the toner cartridge 20 is completed) in the first embodiment. As shown in FIG. 11, the holder 210 includes the second positioning member 214 which positions a rear end of the circuit board 200 held in the holder 210 in the insertion direction (+x direction) and the recess 211 between the first positioning member 213 and the second positioning member 214, and when the toner cartridge 20 not holding the circuit board 200 in the holder 210 is in the attached state, at least a part (more specifically, the apex part 102*a*, for example) of the contact terminal 102 is located in the recess 211.

Figure 12:
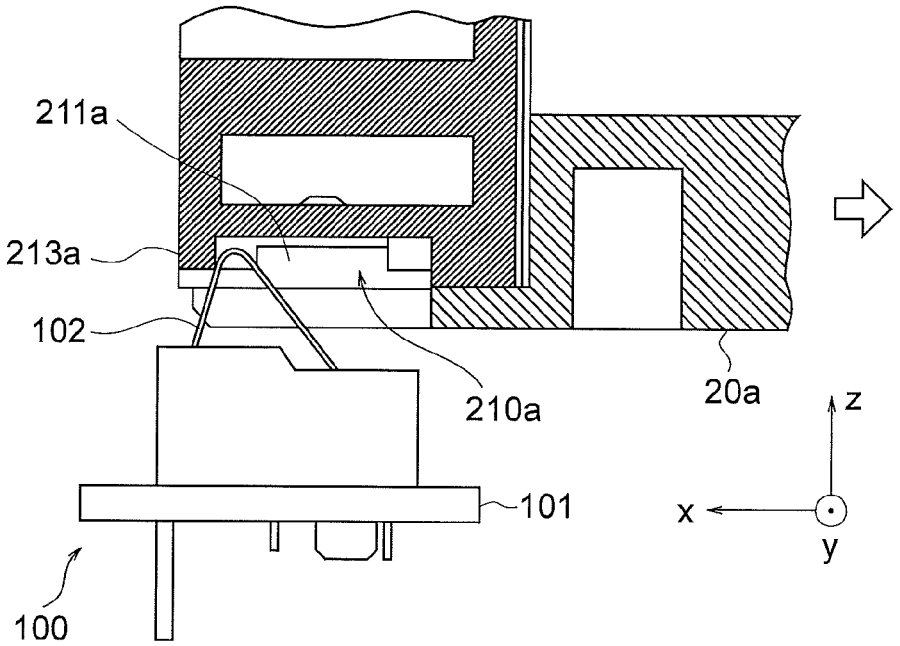
FIG. 12 is an enlarged sectional view showing a toner cartridge holding no circuit board in the holder and a contact terminal provided on the side of the apparatus main body in a comparative example.

FIG. 12 is an enlarged sectional view showing a comparative example, which is a toner cartridge 20*a* as the detachable unit not holding the circuit board 200 in a holder 210*a*, and the contact terminal 102 provided on the side of the apparatus main body. As shown in FIG. 12, a first positioning member 213*a* does not have a notch (a part corresponding to the notch 215 in FIG. 5). FIG. 12 shows a state in which the toner cartridge 20*a* not holding the circuit board 200 in the holder 210*a* is pulled out of (withdrawn from) the apparatus main body along the guide section of the image forming apparatus. When the user slides the toner cartridge 20*a* along the guide section into the apparatus main body, the contact terminal 102 in its initial state meets the first positioning member 213*a* (a positioning part of the circuit board) on a tip end side of the holder 210*a* of the toner cartridge 20*a* and is temporarily pushed down thereby. When the insertion is completed, the contact terminal 102 returns to the initial state by its elastic restoring force and enters into the recess 211*a* (space where the circuit board 200 should be present) of the holder 210*a* of the toner cartridge 20*a*. As shown in FIG. 12, if the user pulls out the toner cartridge 20*a* in that state by sliding it along the guide section, when the contact terminal 102 comes out of the recess 211*a* of the holder 210*a* of the toner cartridge 20*a*, the contact terminal 102 can be caught by the positioning member 213*a* on the tip end side of the holder 210*a* of the toner cartridge 20*a* and can be damaged thereby.

Figure 13:
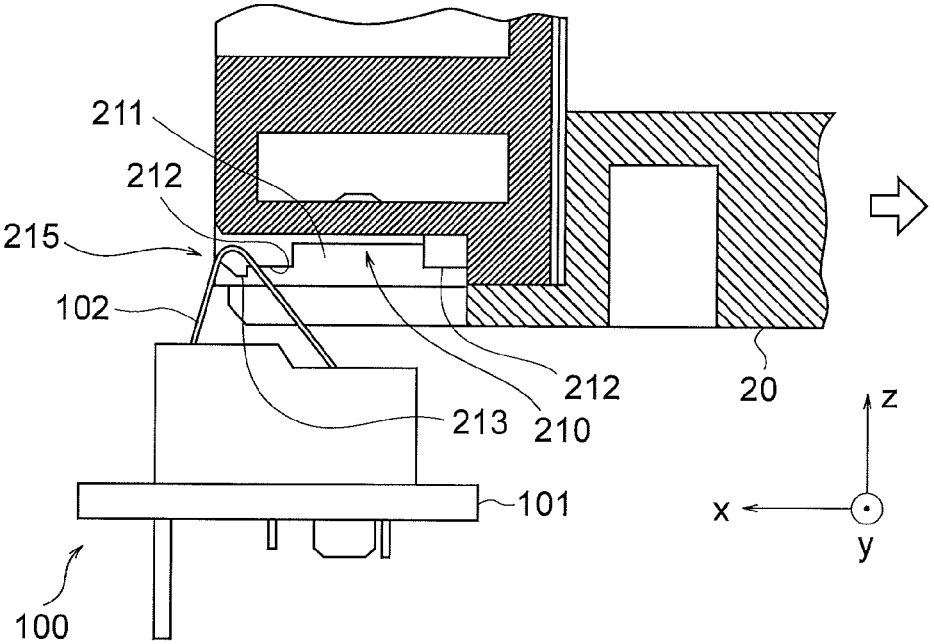
FIG. 13 is an enlarged sectional view showing the toner cartridge holding no circuit board in the holder and the contact terminal provided on the side of the apparatus main body in the first embodiment.

FIG. 13 is an enlarged sectional view showing the toner cartridge 20 not holding the circuit board 200 in the holder 210 (i.e., holding no circuit board in the holder) and the contact terminal 102 provided on the side of the apparatus main body of the image forming apparatus 1 in the first embodiment. As shown in FIG. 13, the first positioning member 213 includes a notch 215 (corresponding to the notch 215 in FIG. 5). FIG. 13 shows a state in which the toner cartridge 20 not holding the circuit board 200 in the holder is pulled out of the apparatus main body along the guide section 3. When the user slides the toner cartridge 20 along the guide section 3 into the apparatus main body, the contact terminal 102 in its initial state passes through the notch 215 of the holder 210 of the toner cartridge 20. When the insertion is completed, the contact terminal 102 is still in its initial state and is located in the recess 211 (space where the circuit board 200 should be present) in the holder 210 of the toner cartridge 20 (FIG. 11). In that state, the locking member of the toner cartridge 20 is engaged with a member in the apparatus main body and is placed in a predetermined position. As shown in FIG. 13, when the user pulls out the toner cartridge 20 in the attached state by sliding it along the guide section 3, the contact terminal 102 being located in the recess 211 of the holder 210 of the toner cartridge 20 passes through the notch 215 without being caught by the first positioning member 213 on the tip end side of the holder 210 of the toner cartridge 20. Therefore, the contact terminal 102 in the example shown in FIG. 13 is not be damaged.

As described above, in the image forming apparatus 1 and the toner cartridge 20 according to the first embodiment, the notch 215 is disposed in the frame (unit main body) of the toner cartridge 20 so that the contact terminal 102 does not meet or touch the frame, the image forming apparatus 1 and the toner cartridge 20 allow the user to pull out the toner cartridge 20 smoothly even when the user pulls out the toner cartridge 20 not holding the circuit board 200 in the holder 210 from the apparatus main body.

First Modification of First Embodiment

Figure 14A:
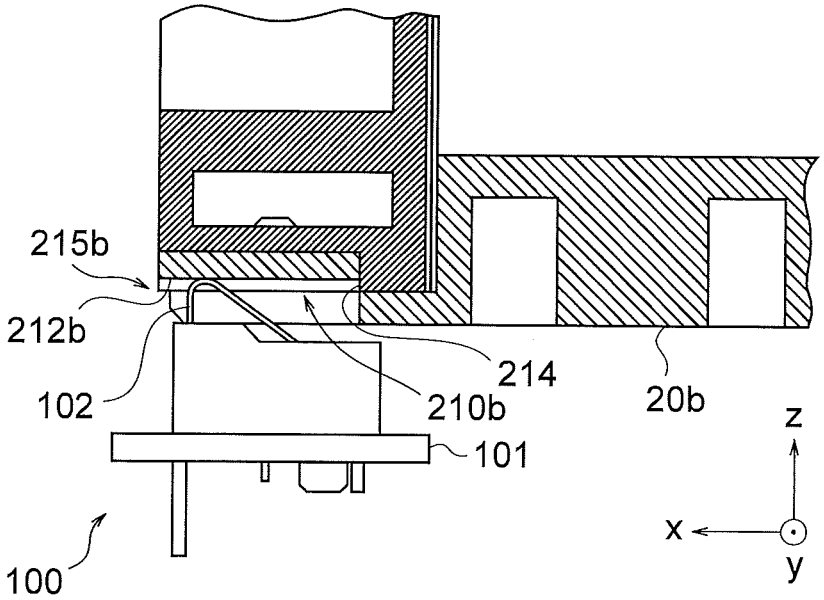
FIG. 14A is an enlarged sectional view showing a toner cartridge holding no circuit board in the holder and a contact terminal on a side of the apparatus main body in a first modification of the first embodiment.
Figure 14B:
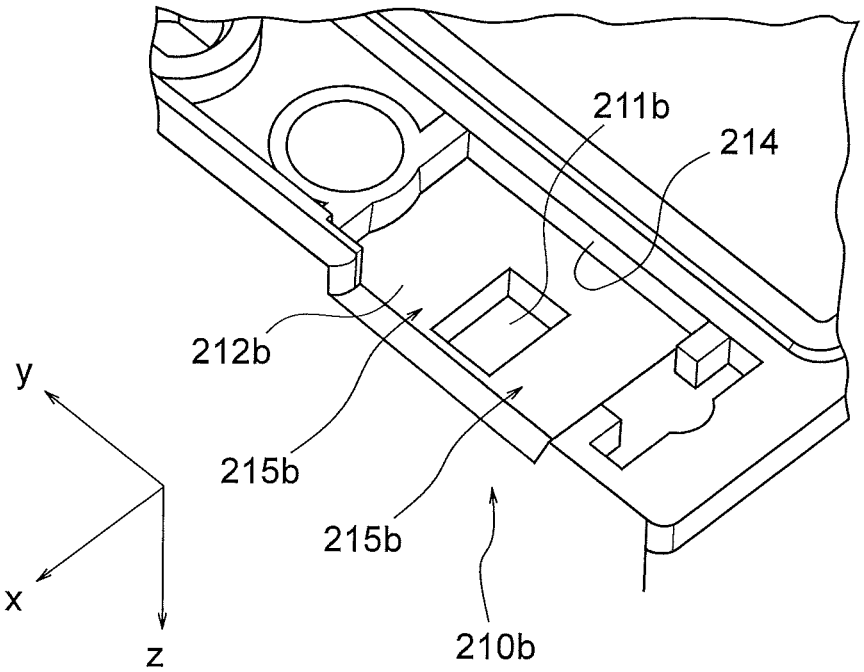
FIG. 14B is an enlarged perspective view of a holder of the toner cartridge in the first modification of the first embodiment.

FIG. 14A is an enlarged sectional view showing a toner cartridge 20*b* holding no circuit board in a holder 210*b* and a contact terminal 102 of an apparatus main body in an image forming apparatus according to a first modification of the first embodiment. FIG. 14B is an enlarged perspective view of the holder 210*b* in FIG. 14A. In FIGS. 14A and 14B, components identical to or corresponding to the components shown in FIG. 13 are denoted by the same reference numerals as used in FIG. 13. In the example shown in FIGS. 14A and 14B, a shape of the holder 210*b* differs from that shown in FIG. 13. In the example shown in FIGS. 14A and 14B, a face 212*b* corresponding to the top face of the rib 212 in FIG. 5 is formed across an area excluding a recess 211*b* of the holder 210*b*, the bottom (top face) of a part (notch or cut part) 215*b* corresponding to the notch 215 is on the same level as the face 212*b*. In other words, the face 212*b* and the part 215*b* form a flat face. The part 215*b* corresponding to the notch 215 is formed on an end part of the holder 210*b* in the x direction. In this example, the face 212*b* of the holder 210*b* touches the contact terminal 102, but since no member has such a shape that the contact terminal 102 is caught, when the toner cartridge 20*b* is pulled out in the withdrawal direction, damage to the contact terminal 102 can be prevented. Further, the contact terminal 102 does not enter the recess 211*b*. Furthermore, the face 212*b* in the holder 210*b* may be configured not to touch the contact terminal 102. Otherwise, the example shown in FIGS. 14A and 14B is the same as that shown in FIG. 13. As described above, in the image forming apparatus and the toner cartridge 20*b* according to the first modification of the first embodiment, the image forming apparatus and the toner cartridge 20*b* allow the user to pull out the toner cartridge 20*b* smoothly even when the user pulls out the toner cartridge 20*b* not holding the circuit board 200 in the holder 210*b* from the apparatus main body.

Second Modification of First Embodiment

Figure 15:
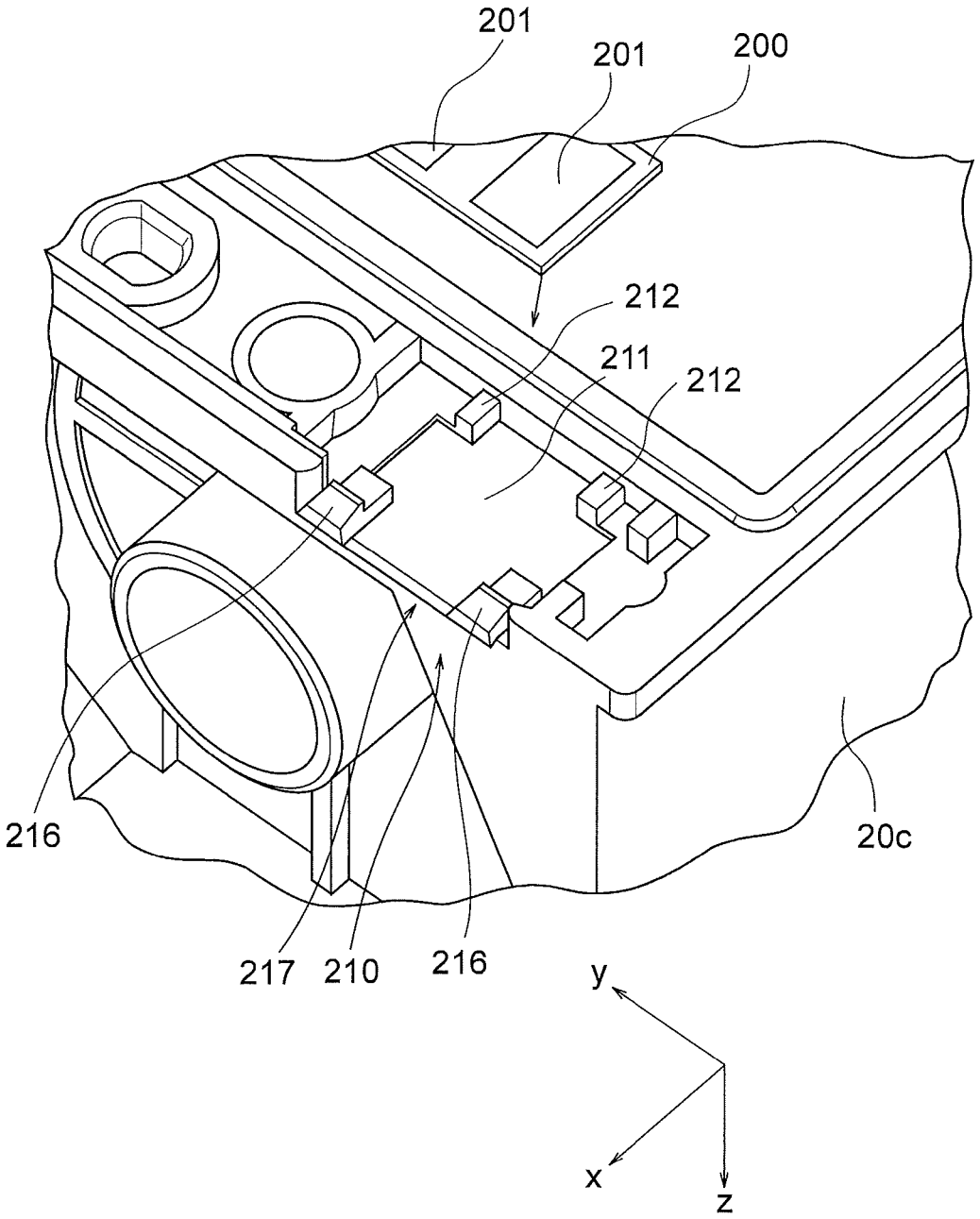
FIG. 15 is an enlarged perspective view showing a toner cartridge holding no circuit board in the holder in a second modification of the first embodiment.

FIG. 15 is an enlarged perspective view showing a part of a toner cartridge 20*c* not holding a circuit board in the holder in an image forming apparatus according to a second modification of the first embodiment. In FIG. 15, components identical to or corresponding to the components shown in FIG. 5 are denoted by the same reference numerals as used in FIG. 5. In the example shown in FIG. 15, shapes of the first positioning parts 216 differ from those shown in FIG. 5, and a shape of the notch 217 differs from that shown in FIG. 5. In the example shown in FIG. 15, the first positioning parts 216 are formed near both ends of the holder 210 in the y direction instead of in the center of the holder 210 in the y direction. The notch 217, through which the contact terminal 102 passes, is formed around the center of the holder 210 in the y direction. Since no member has such a shape that the contact terminal 102 is caught, when the toner cartridge 20*c* is pulled out in the withdrawal direction, damage to the contact terminal 102 can be prevented. Otherwise, the example shown in FIG. 15 is the same as the example shown in FIG. 5. As described above, in the image forming apparatus and the toner cartridge 20*c* according to the second modification of the first embodiment, the image forming apparatus and the toner cartridge 20*c* allow the user to pull out the toner cartridge 20*c* smoothly even when the user pulls out the toner cartridge 20*c* not holding the circuit board 200 in the holder 210 from the apparatus main body.

Second Embodiment

In the first embodiment, the connectors 103*a* and 103*b* electrically connected to the contact terminals 102 are disposed near the contact terminals 102 of the terminal board 100 mounted on the apparatus main body. If the signal cables 106 that connect the connectors 103*a* and 103*b* with the control section 6 of the image forming apparatus 1 or connect the connectors 103*a* and 103*b* with the connectors of the adjacent terminal board 100 (in series) are disposed on a face of the board part (printed board) 101 of the terminal board 100 on which the contact terminals 102 is disposed, the signal cables 106 could be damaged when they touch the toner cartridge 20 which is sliding.

In an image forming apparatus according to a second embodiment, the signal cables 106 are routed from the connectors 103*a* and 103*b* of the terminal board 100 through the L-shaped notches 104 toward a back face (i.e., the second face) and fixed on the back face. Although the route of the signal cable 106 is not limited in the first embodiment, the signal cable 106 in the second embodiment is routed to and fixed on the back face of the terminal board 100. Otherwise, the second embodiment is the same as the first embodiment (FIGS. 1 to 11, FIGS. 13 to 15) or the comparative example (FIG. 12).

Figure 16A:
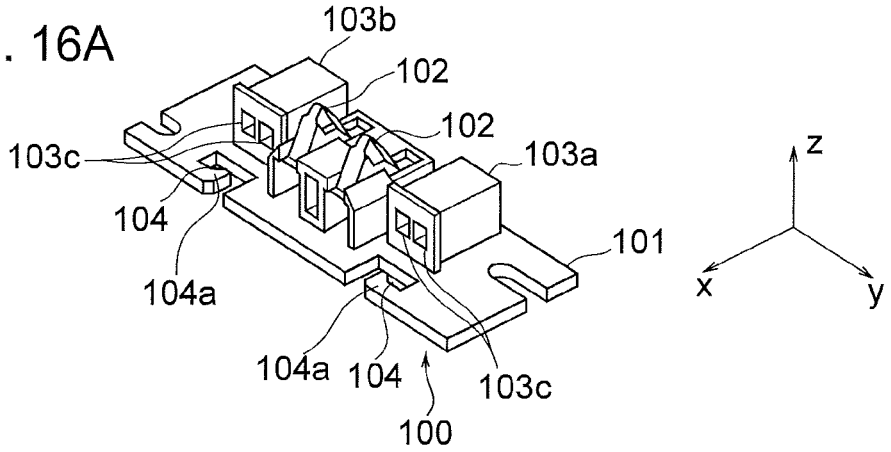
FIG. 16A is a perspective view schematically showing a terminal board of an image forming apparatus in a second embodiment of the present invention.
Figure 16B:
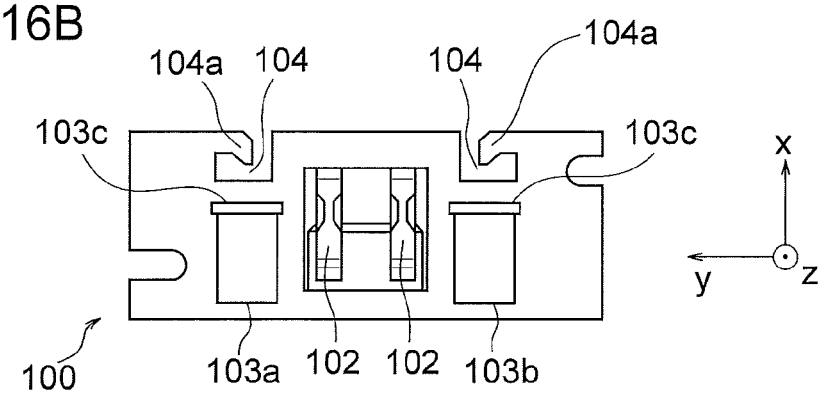
FIG. 16B is a plan view schematically showing the terminal board of the image forming apparatus in the second embodiment.
Figure 16C:
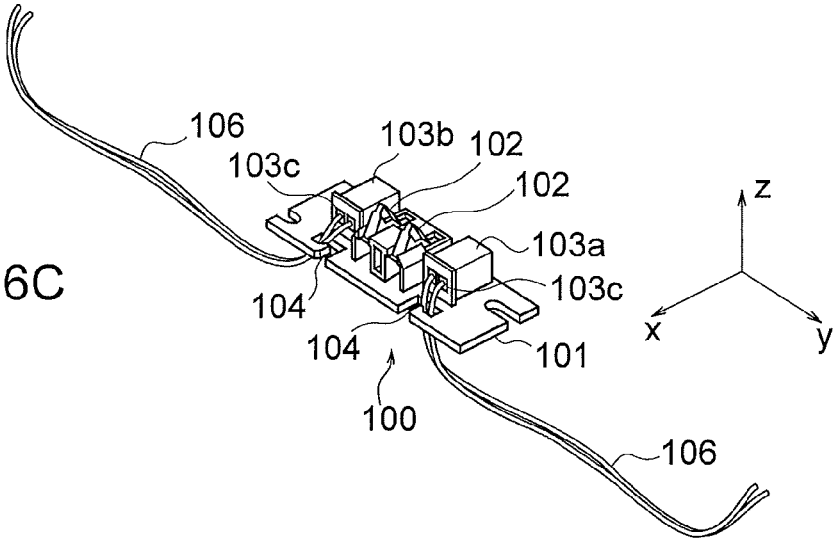
FIG. 16C is a perspective view schematically showing the terminal board and signal cables in the second embodiment.
Figure 17:
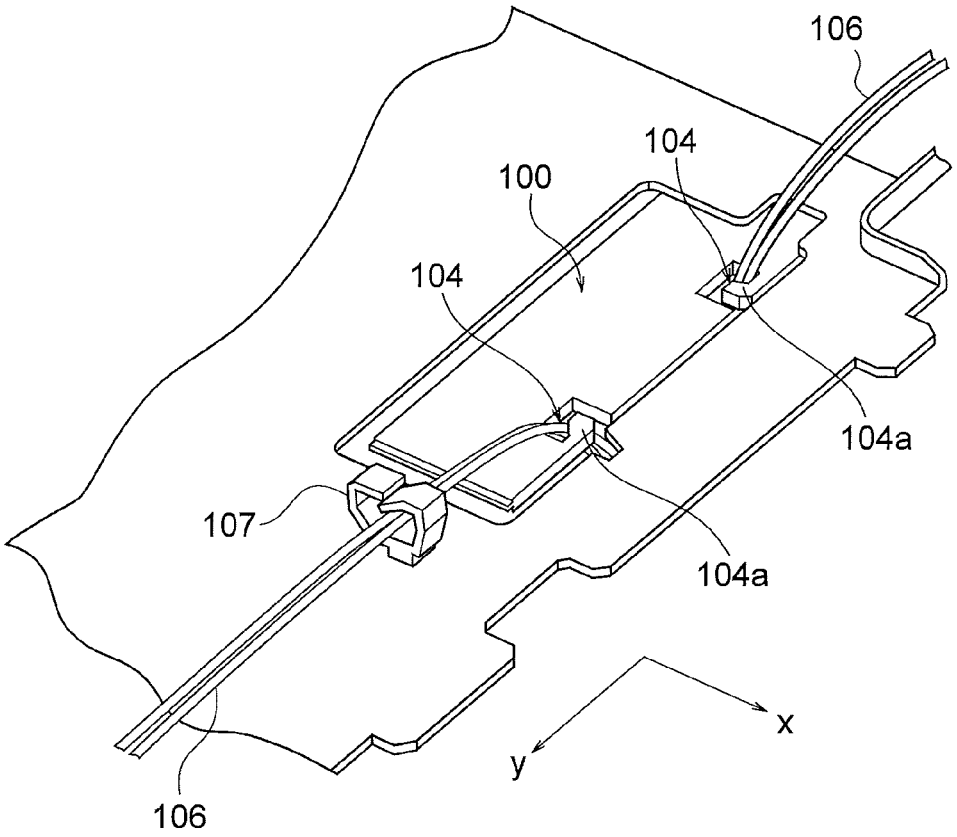
FIG. 17 is an enlarged perspective view showing the signal cables and terminal board (back face side) mounted on the apparatus main body of the image forming apparatus in the second embodiment.
Figure 18:
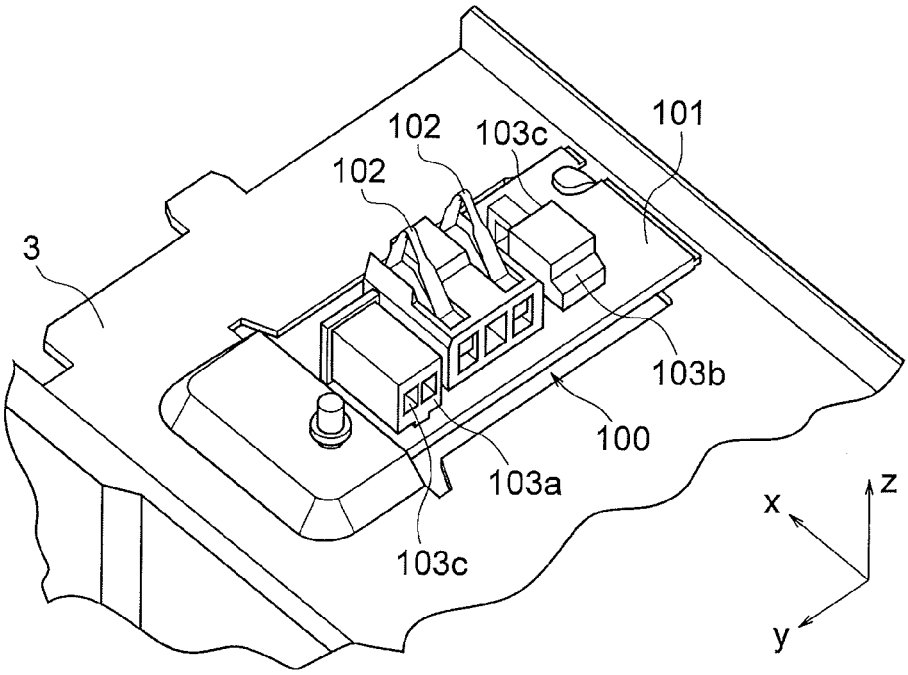
FIG. 18 is an enlarged perspective view showing the terminal board (contact terminal side) mounted on the apparatus main body of the image forming apparatus in the second embodiment.
Figure 19:
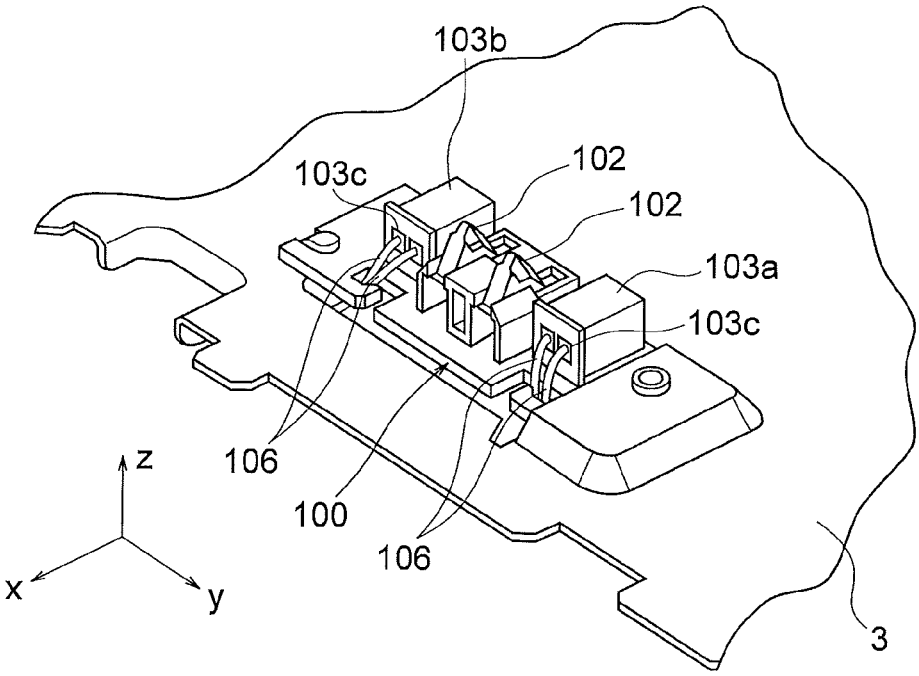
FIG. 19 is an enlarged perspective view showing the signal cables and terminal board (contact terminal side) mounted on the apparatus main body of the image forming apparatus in the second embodiment.
Figure 20:
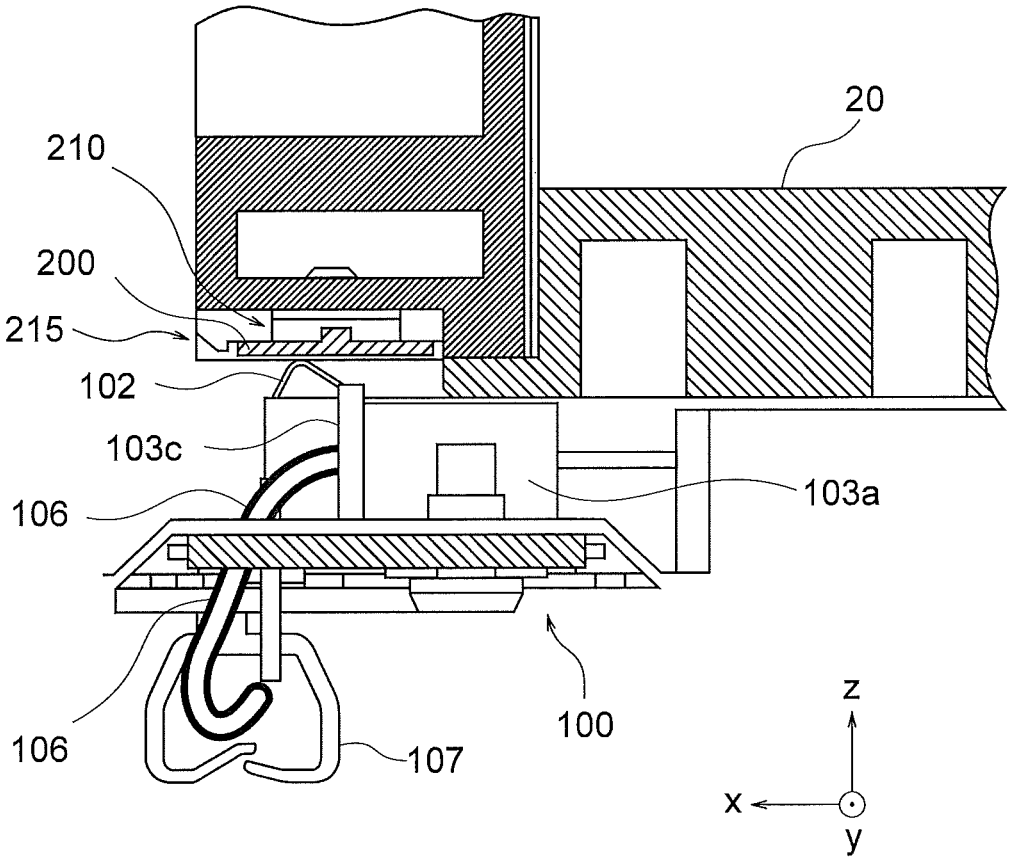
FIG. 20 is a longitudinal sectional view showing the signal cable and the terminal board (contact terminal side) mounted on the apparatus main body of the image forming apparatus in the second embodiment.

FIGS. 16A to 16C are views schematically showing the terminal board 100 of the image forming apparatus according to the second embodiment of the present invention. FIG. 16A is a perspective view of the terminal board 100. FIG. 16B is a plan view of the terminal board 100. FIG. 16C is a perspective view showing the terminal board 100 and the signal cables 106. FIG. 17 is an enlarged perspective view showing the signal cables 106 and the terminal board 100 mounted on the apparatus main body of the image forming apparatus in the second embodiment, viewed from the back side of the terminal board 100. FIG. 18 is an enlarged perspective view showing the terminal board 100 mounted on the apparatus main body of the image forming apparatus in the second embodiment. FIG. 19 is an enlarged perspective view showing the signal cables 106 and the terminal board 100 mounted on the apparatus main body of the image forming apparatus in the second embodiment. FIG. 20 is a longitudinal sectional view showing the signal cable 106 and the terminal board 100 mounted on the apparatus main body of the image forming apparatus in the second embodiment.

As shown in FIGS. 16A to 16C and FIG. 20, the connectors 103*a* and 103*b* have a slot 103*c* into which the signal cable 106 is inserted. The signal cable 106 inserted into the slot 103*c* is extends from the first face on which the connectors 103*a* and 103*b* are disposed to the second face opposite to the first face along the cable guide (more specifically, an L-shaped notch 104, for example). As shown in FIGS. 16A and 16B, the terminal board 100 (more specifically, the L-shaped notch 104, for example) includes a hook 104*a* as a bent part which prevents the signal cable 106 from coming out of the L-shaped notch 104. This structure prevents the signal cable 106 put into the deepest part of the L-shaped notch 104 from coming out. As shown in FIG. 17, a clamp 107 is disposed on the back side of the plate supporting the terminal board 100 (or the back side of the guide section 3), and the clamp 107 holds the signal cable 106. The signal cables 106 are connected to the contact terminals 102 by the connectors 103*a* and 103*b*. It is preferable that the connectors 103*a* and 103*b* be an angle connector having two connection terminals disposed to form a right angle to each other and to electrically connect the contact terminals 102 and the signal cables 106 by connecting a vertically downward cable and a horizontal cable thereof. It is preferable that the angle connector include a slot configured to be inserted by the signal cable 106 and to face in the insertion direction. In the example shown in FIG. 18, the slots 103*c* of the connectors 103*a* and 103*b* face in different directions. It is, however, preferred that the connectors 103*a* and 103*b* are disposed in such a manner that all the slots 103*c* face the tip end side of the toner cartridge 20 in the insertion direction (+x direction), as shown in FIG. 19 and FIG. 20. This structure makes it possible to avoid contact between the signal cable 106 and the toner cartridge 20 when the toner cartridge 20 is inserted into the apparatus main body. The structure of the cable guide is not limited to L-shape such as the L-shaped notch 104. The terminal board 100 may include a through hole as a part of the cable guide to pass the signal cable 106.

To prevent a signal cable from touching a sliding member such as a toner cartridge, it is preferable that the signal cable be covered with a cover member or that a connector connected to a contact terminal be disposed on a face opposite to a face on which the contact terminal is disposed, for example. In the image forming apparatus in the second embodiment, however, the connectors 103*a* and 103*b* and the contact terminal 102 are disposed on the same face of the terminal board 100, the signal cables 106 connected to the connectors 103*a* and 103*b* are routed through the L-shaped notches 104 toward the back face of the terminal board 100, and the signal cables 106 are fixed on the back face of the terminal board 100. Accordingly, in the second embodiment, damage to the signal cable 106 can be prevented by the simple structure.

In the second embodiment, the most part of the signal cable 106 is placed on the opposite side to the toner cartridge 20 across the terminal board 100, and there is little possibility that the signal cable 106 touches the toner cartridge 20. Even when adjacent terminal boards 100 are connected in series by the signal cable 106, the signal cable 106 can be routed on the face (back face of the guide section 3) opposite to the face on which the toner cartridge 20 is disposed, and flexibility of cabling increases.

The L-shaped notch 104 of the terminal board 100 which functions as the cable guide is formed near the end part of the terminal board 100. Alternatively, a through hole which functions as the cable guide may be formed in a position near the center of the terminal board 100. If the through hole is used as the cable guide, it is necessary to put the signal cable 106 into the through hole from its end. If the L-shaped notch 104 is used as the cable guide, since the signal cable 106 can be put into the L-shaped notch 104 at a given middle point, using the L-shaped notch 104 as the cable guide facilitates the cabling.

Modification

The toner cartridge as the developer cartridge containing a developer has been described above as an example of a detachable unit to which the present invention is applied. The present invention can also be applied to an image forming unit including a photosensitive drum as an image carrier on which the electrostatic latent image is formed, a transfer belt unit including an intermediate transfer belt onto which the developer image formed on the image carrier is transferred, a fixing unit including fixing rollers which fixes the developer image onto the recording medium, and other detachable units configured so that they are inserted into and pulled out of the apparatus main body by being slid.

What is claimed is:

1. An image forming apparatus comprising:

an apparatus main body including a guide section and a contact terminal as a spring; and a detachable unit including a holder for holding a circuit board having an electrode terminal which comes into contact with the contact terminal, a state of the detachable unit being changed to an attached state by inserting the detachable unit along the guide section in an insertion direction, the state of the detachable unit being changed to a detached state by withdrawing the detachable unit along the guide section in a withdrawal direction opposite to the insertion direction, wherein:

the holder includes a first positioning member for positioning a tip end of the circuit board in the insertion direction when the detachable unit holding the circuit board in the holder is slid along the guide section to be inserted in the insertion direction; and the first positioning member forms two slit parts, through which the contact terminal passes when the detachable unit not holding the circuit board in the holder in the attached state is slid in the withdrawal direction.

2. The image forming apparatus of claim 1, wherein:

the holder includes a second positioning member which positions a rear end of the circuit board in the insertion direction, the rear end being opposite to the tip end; and a recess formed between the first positioning member and the second positioning member; and at least a part of the contact terminal is located in the recess when the detachable unit not holding the circuit board in the holder is in the attached state.

3. The image forming apparatus of claim 1, wherein the contact terminal is in contact with the electrode terminal when the detachable unit holding the circuit board in the holder is in the attached state.

4. The image forming apparatus of claim 1, wherein the electrode terminal is a tabular electrode parallel to the insertion direction.

5. The image forming apparatus of claim 1, wherein:

the contact terminal changes from an initial state, in which no load is applied to the contact terminal, to a contact state, in which the contact terminal is pushed down by the circuit board, when the detachable unit holding the circuit board in the holder is inserted into the apparatus main body; and the contact terminal returns from the contact state to the initial state when the detachable unit holding the circuit board in the holder is withdrawn from the apparatus main body.

6. The image forming apparatus of claim 1, wherein the contact terminal includes:

a fixed end fixed to the apparatus main body, the fixed end being formed on a rear end side in the insertion direction;

a free end formed on a tip end side opposite to the rear end side in the insertion direction; and an apex part formed between the fixed end and the free end, the apex part being formed by bending a plate member into L-shape.

7. The image forming apparatus of claim 1, wherein the detachable unit is a developer cartridge containing a developer.

8. The image forming apparatus of claim 1, wherein the detachable unit is an image forming unit including an image carrier on which an electrostatic latent image is formed.

9. The image forming apparatus of claim 1, wherein the detachable unit is a fixing unit which fixes a developer image onto a recording medium.

10. The image forming apparatus of claim 1, wherein:

the holder includes a second positioning member which positions a rear end of the circuit board in the insertion direction, the rear end being opposite to the tip end;

a recess is formed between the first positioning member and the second positioning member; and bottom faces of the slit parts and the recess are on a same level in height.

11. A detachable unit configured to be inserted into and to be withdrawn from an image forming apparatus that includes a guide section and a contact terminal as a spring, a state of the detachable unit being changed to an attached state by inserting the detachable unit along the guide section in an insertion direction, the state of the detachable unit being changed to a detached state by withdrawing the detachable unit along the guide section in a withdrawal direction opposite to the insertion direction, the detachable unit comprising:

a unit main body; and a holder provided on the unit main body, the holder being configured to hold a circuit board including an electrode terminal which comes into contact with the contact terminal, wherein the holder includes a first positioning member for positioning a tip end of the circuit board in the insertion direction when the detachable unit holding the circuit board in the holder is slid along the guide section to be inserted in the insertion direction; and the first positioning member forms two slit parts through which the contact terminal passes when the detachable unit not holding the circuit board in the holder in the attached state is slid in the withdrawal direction.

12. The detachable unit of claim 11, wherein the holder includes a second positioning member which positions a rear end of the circuit board in the insertion direction, the rear end being opposite to the tip end; and a recess formed between the first positioning member and the second positioning member; and at least a part of the contact terminal is located in the recess when the detachable unit not holding the circuit board in the holder is in the attached state.

13. The detachable unit of claim 11, wherein the electrode terminal is a tabular electrode parallel to the insertion direction.

14. The detachable unit of claim 11, wherein the holder includes a second positioning member which positions a rear end of the circuit board in the insertion direction, the rear end being opposite to the tip end;

a recess is formed between the first positioning member and the second positioning member; and bottom faces of the slit parts and the recess are on the same level in height.

15. An image forming apparatus comprising:

an apparatus main body including a guide section and a contact terminal as a spring;

a detachable unit including a holder for holding a circuit board having an electrode terminal which comes into contact with the contact terminal, a state of the detachable unit being changed to an attached state by inserting the detachable unit along the guide section in an insertion direction, the state of the detachable unit being changed to a detached state by withdrawing the detachable unit along the guide section in a withdrawal direction opposite to the insertion direction;

a base plate including a first face and a second face opposite to the first face, the base plate supporting the contact terminal on the first face;

a signal cable connected to the contact terminal; and a cable guide, along which the signal cable extends from the first face to the second face, wherein:

the holder includes a first positioning member for positioning a tip end of the circuit board in the insertion direction when the detachable unit holding the circuit board in the holder is slid along the guide section to be inserted in the insertion direction; and the first positioning member forms a slit part through which the contact terminal passes when the detachable unit not holding the circuit board in the holder in the attached state is slid in the withdrawal direction.

16. The image forming apparatus of claim 15, wherein the base plate includes an L-shaped notch as a part of the cable guide.

17. The image forming apparatus of claim 16, wherein the base plate includes a hook which prevents the signal cable from coming out of the L-shaped notch.

18. The image forming apparatus of claim 15, wherein the base plate includes a through hole as a part of the cable guide.

19. The image forming apparatus of claim 15, wherein:

the base plate further includes an angle connector which electrically connects the contact terminal and the signal cable; and the angle connector includes a slot configured to be inserted by the signal cable, the slot facing the insertion direction.

* * * * *